US010084251B2

(12) United States Patent
Sun et al.

(10) Patent No.: US 10,084,251 B2
(45) Date of Patent: Sep. 25, 2018

(54) DEFLECTABLE LATCH WITH RECESSED BOTTOM SECTION

(71) Applicant: FOXCONN INTERCONNECT TECHNOLOGY LIMITED, Grand Cayman (KY)

(72) Inventors: Wei-Guo Sun, Kunshan (CN); Guang-Lei Xu, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/841,249

(22) Filed: Dec. 13, 2017

(65) Prior Publication Data

US 2018/0166806 A1 Jun. 14, 2018

(30) Foreign Application Priority Data

Dec. 13, 2016 (CN) ..... 2016 2 1362836 U

(51) Int. Cl.
*H01R 13/62* (2006.01)
*H01R 12/70* (2011.01)
*H01R 12/72* (2011.01)

(52) U.S. Cl.
CPC ..... *H01R 12/7023* (2013.01); *H01R 12/721* (2013.01)

(58) Field of Classification Search
CPC ..... H01R 23/682; H01R 23/7005; H01R 23/7068; H01R 23/7026
USPC ..... 439/326, 328
See application file for complete search history.

(56) References Cited

U.S. PATENT DOCUMENTS 7,789,692 B2 * 9/2010 Lee ..... H01R 12/721 439/327
7,927,114 B2 * 4/2011 Li ..... H01R 12/721 439/108
8,083,534 B2 * 12/2011 Pipho ..... H01R 13/64 439/326
8,398,422 B2 * 3/2013 Zhu ..... H01R 13/428 439/326

FOREIGN PATENT DOCUMENTS

CN 103682759 B 3/2014

* cited by examiner

*Primary Examiner* — Hien Vu
(74) *Attorney, Agent, or Firm* — Wei Te Chung; Ming Chieh Chang

(57) ABSTRACT

An electrical connector includes an insulative housing with a plurality of contacts therein. The housing includes an elongated base extending along a longitudinal direction, and a pair of deflectable latches extending forwardly from two opposite ends of the base. The base includes a first side wall and a second side wall commonly define a receiving slot is therebetween in a vertical direction to receive a memory module therein. Each latch forms an inner face confronting a corresponding side edge of the memory module. The inner face is recessed around a bottom/root section of the latch so as to be spaced from the side edge of the memory module for not potentially damaging the side edge of the memory module during rotational installation of the memory module into the connector.

6 Claims, 5 Drawing Sheets

DEFLECTABLE LATCH WITH RECESSED BOTTOM SECTION

1. FIELD OF THE DISCLOSURE

The invention is related to an electrical connector, and particularly to the electrical connector with the deflectable latch with a recessed bottom section or a recessed root section.

2. DESCRIPTION OF RELATED ARTS

U.S. Pat. No. 9,190,754 discloses an electrical connector including an elongated base with a pair of deflectable latches extending forwardly from two opposite ends of the base. The base forms a receiving slot to receive therein a memory module or electronic card which is loaded into or unloaded from the receiving slot in a rotational manner. The latches lock the memory module in position with regard to the housing. The inner surface of the latch extends essentially in a coplanar manner along and aligned with the front-to-back direction, thus potentially damaging the memory module around a bottom section of the deflectable latch during rotational operation.

It is desired to provide an electrical connector with the deflectable latch not to damage the corresponding memory module during rotational installation.

SUMMARY OF THE DISCLOSURE

To achieve the above desire, an electrical connector includes an insulative housing with a plurality of contacts therein. The housing includes an elongated base extending along a longitudinal direction, and a pair of deflectable latches extending forwardly from two opposite ends of the base in a front-to-back direction perpendicular to the longitudinal direction. The base includes a first side wall and a second side wall opposite to each other in a vertical direction perpendicular to both the longitudinal direction and the front-to-back direction. A receiving slot is formed between the first side wall and the second side wall in the vertical direction to receive a memory module therein. Each latch forms an inner face confronting a corresponding side edge of the memory module. The inner face is recessed around a bottom section of the latch so as to be spaced from the side edge of the memory module for not potentially damaging the side edge of the memory module during rotational operation of the memory module.

DETAILED DESCRIPTION OF THE PREFERRED EMBODIMENT

Figure 1:
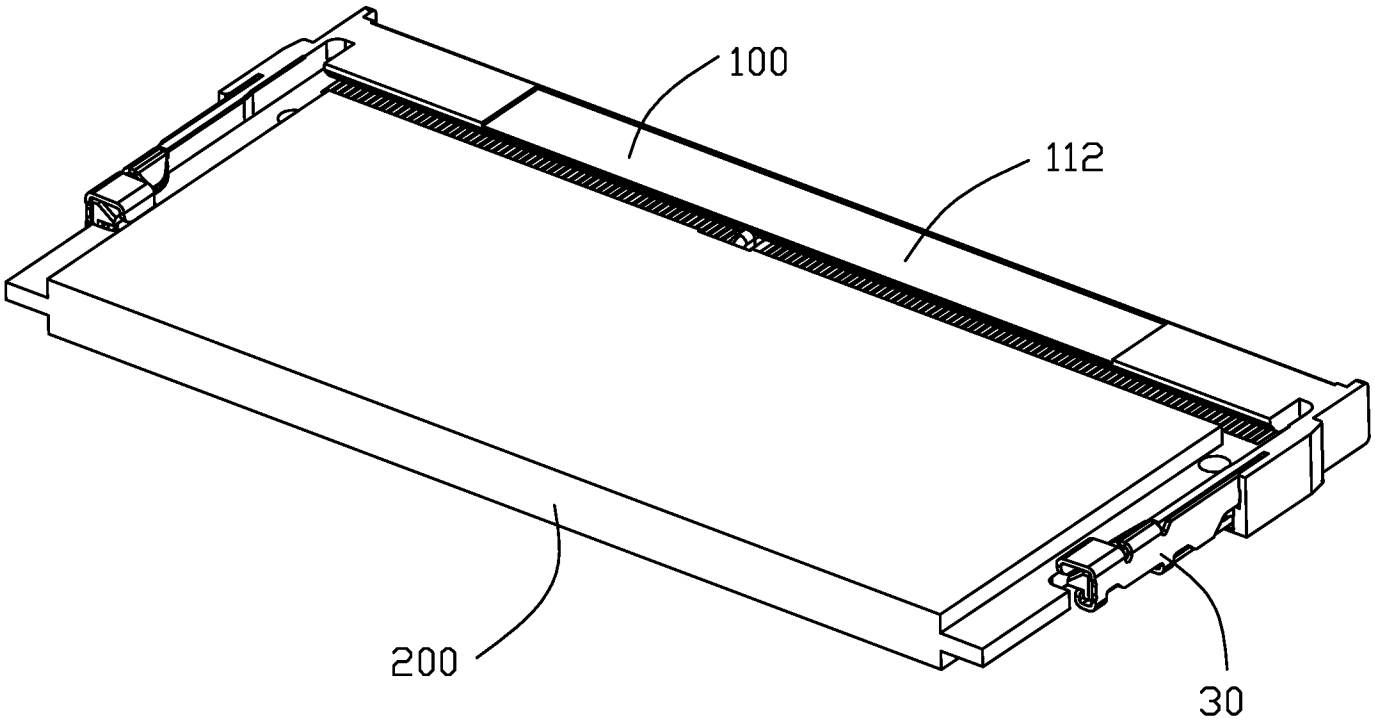
FIG. 1 is a front perspective view of an electrical connector with an memory module therein according to the invention.
Figure 2:
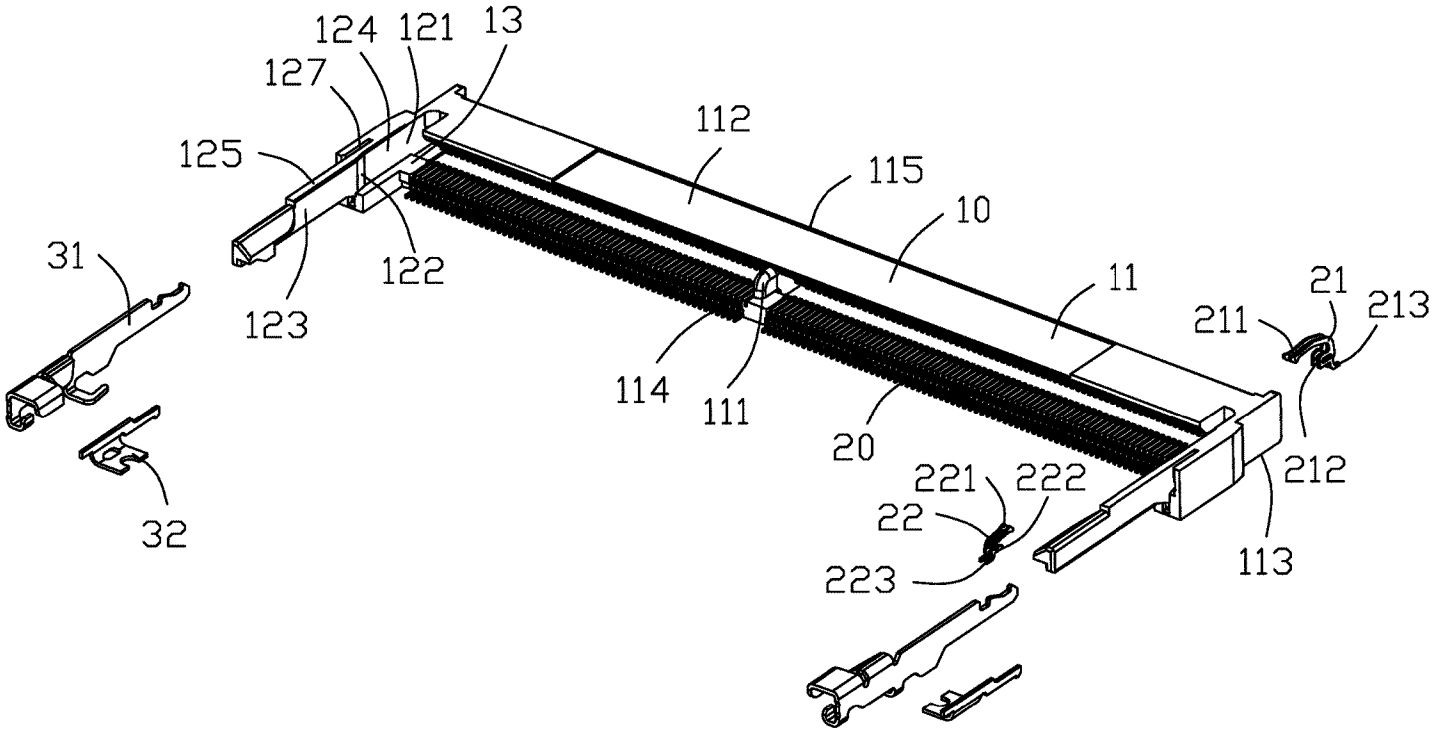
FIG. 2 is a front exploded perspective view of the electrical connector of FIG. 1.
Figure 3:
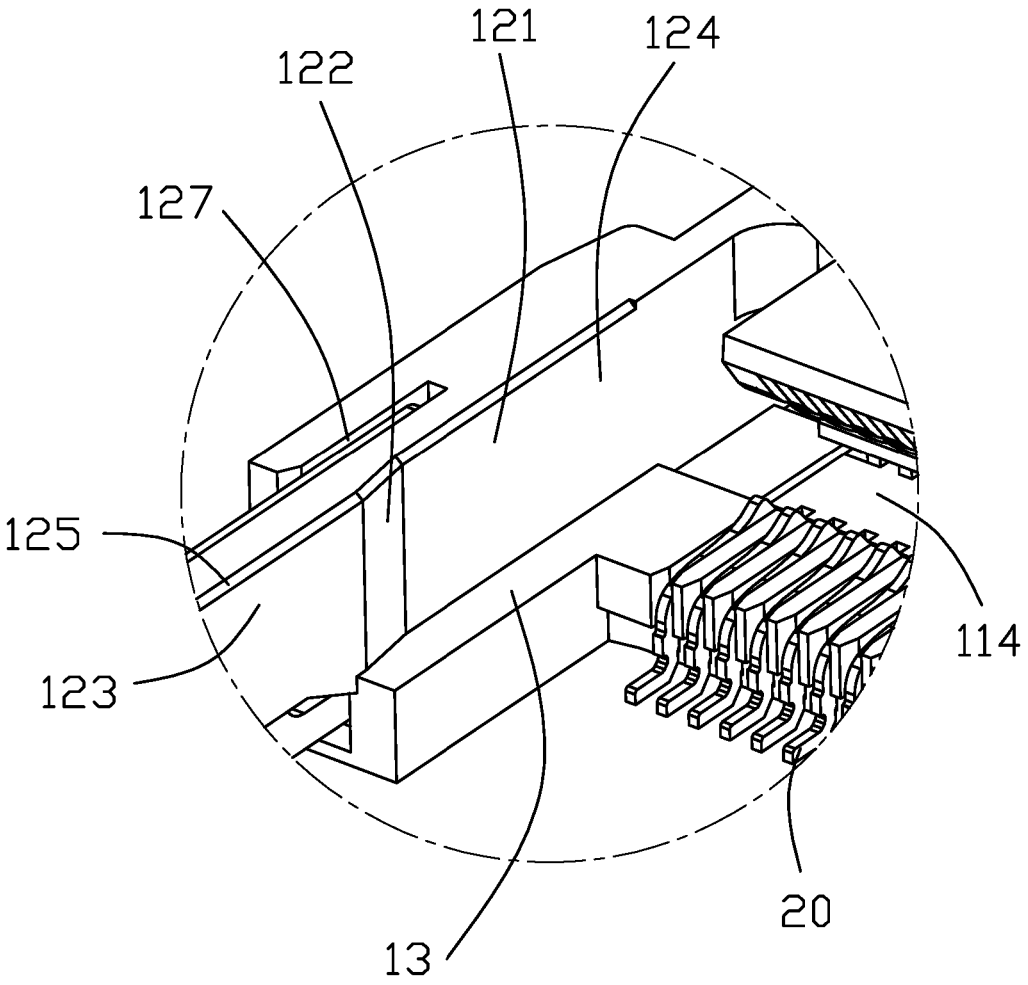
FIG. 3 is an enlarged perspective view of a part of the electrical connector of FIG. 1.
Figure 4:
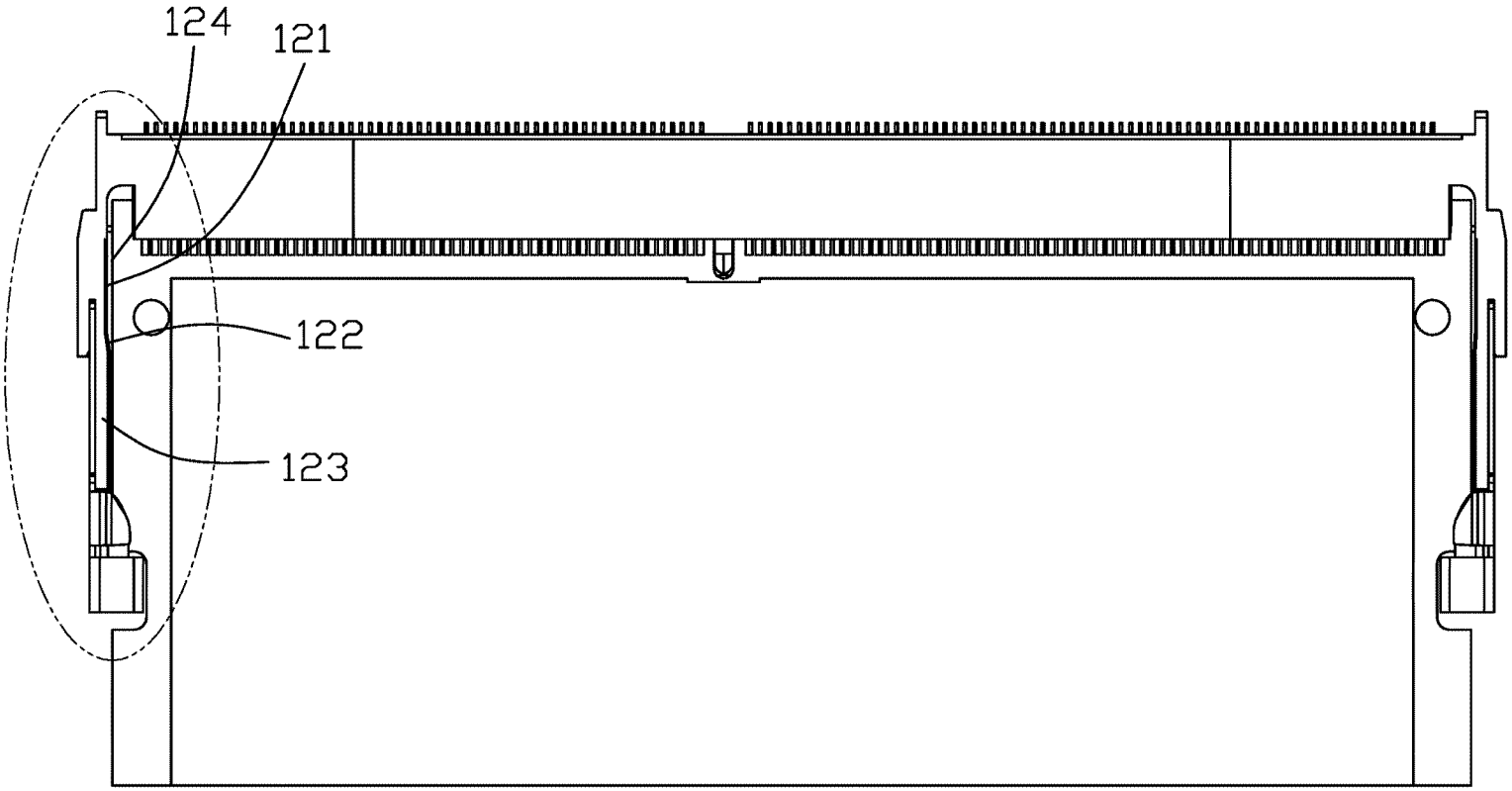
FIG. 4 is a top view of the electrical connector of FIG. 1.
Figure 5:
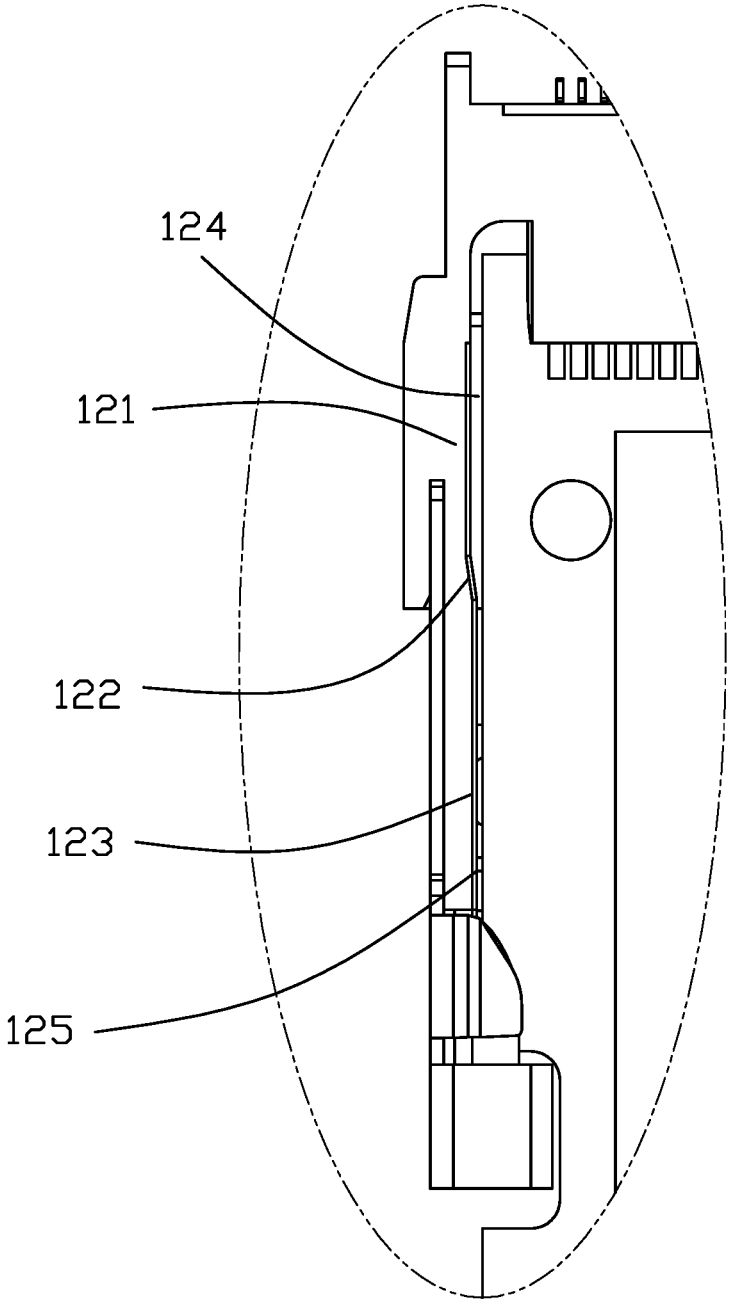
FIG. 5 is an enlarged top view of a part of the electrical connector of FIG. 1.

Reference will now be made in detail to the embodiments of the present disclosure. Referring to FIGS. 1-5, a card edge type electrical connector 100 receiving a memory module or electronic card 200 therein, includes an insulative housing 10, a plurality of contacts 20 disposed in the housing 20, and a pair of metallic locking pieces 30 assembled upon the housing 10 to lock the memory module 200 in position. The memory module forms a front edge and two lateral side edges thereof.

The insulative housing 10 include an elongated base 11 extending along a longitudinal direction, a pair of end walls 121 at two opposite ends of the base 11, and a pair of deflectable latches 123 extending forwardly from the corresponding end walls 121, respectively, in a front-to-back direction perpendicular to the longitudinal direction. The base 11 includes first/upper side wall 112, a second/lower side wall 113 opposite to the first side wall 112 in the vertical direction perpendicular to both the longitudinal direction and the front-to-back direction, and a rear wall linked between the first side wall 112 and the second side wall 113. A receiving slot 114 is formed between the first side wall 112 and the second side wall 113 in the vertical direction. The front edge of the memory module 200 is received within the receiving slot via a rotational operation. The contacts 20 includes first/upper contacts 21 and second/lower contacts 22 respectively disposed in the corresponding first side wall 112 and second side wall 113. The first contact 21 includes a first retaining section 212 to retain to the first wall 112, a first contacting section 211 forwardly extending from the first retaining section 212 into the receiving slot 114, and a first soldering section 213 rearwardly extending from the first retaining section 212 out of the housing 10. Similarly, the second contact 22 includes a second retaining section 222 retained to the second wall 113, a second contacting section 221 extending rearward from the second retaining section 222 into the receiving slot 114, and a second soldering section 223 extending forwardly from the second retaining section 222. A key 111 is formed in the receiving slot 114 for orientation of the memory module 200 during installation.

The end wall 121 and the corresponding latch 123 commonly forms an inner face confronting the corresponding side edge of the memory module 200. In this embodiment, a recess 124 is formed in the inner face of the end wall 121 so as to be outwardly offset from the inner face of the corresponding deflectable latch 123 in the longitudinal direction. Therefore, when the memory module 200 is received within the receiving slot 114, a side edge of the memory module 200 is spaced from the inner face of the end wall 200 so as not to potentially damage the side edge of the memory module 200 during rotational loading/unloading with regard to the electrical connector 100. In details, an tapered transition surface 122 is formed between the inner face of the end wall 121 and the deflectable latch 123. A supporting platform 13 is formed around the end wall 121, and a guiding chamfer 125 is formed at a top edge of both the end wall 121 and the deflectable latch 123 for downwardly leading the memory module 200 toward the housing 10. The end wall 121 further includes a groove 127, and via the groove 127 a locking piece 31 of a metallic latch 30 is attached to the deflectable latch 123, and a mounting pad 32 of the metallic latch 30 is for soldering to a mother board on which the housing 10 is seated.

Notably, in this embodiment, the end wall 121 is essentially immovable because of unitarily linking with the supporting platform 131, and the recess 124 is solely formed in the end wall 121. Therefore, the recess 124 may be deemed to be formed around a root section of the deflectable 123. Alternately, in another embodiment the recess 124 may be additionally in or around the bottom section of the deflectable latch 123 because the bottom section of the deflectable latch 123 is essentially less movable during outward deflection of the latch 123. In other words, the end wall and the deflectable latch may be deemed as one piece in some viewpoint. It is also noted that the latch 123 may be equipped with or without its own locking/protruding lug (not labeled). In this embodiment, the deflectable latch 123 and the metallic latch 30 commonly form the meaningful latch for locking the memory module 200 in position. In other embodiments, the latch 123 may remove the corresponding locking/protruding lug but having the metallic latch 30 associated therewith.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical connector comprising:

an insulative housing including an elongated base and a pair of end walls at two opposite ends along a longitudinal direction, said base including opposite upper wall and lower wall with a receiving slot therebetween in a vertical direction perpendicular to said longitudinal direction for receiving a front edge region of a memory module therein;

a pair of deflectable latches extending forwardly from the corresponding end walls, respectively, in a front-to-back direction perpendicular to both said longitudinal direction and said vertical direction; and an inner face defined by the end wall and facing the receiving slot in the longitudinal direction, forms a recess with regard to another inner face defined by the corresponding deflectable latch and facing the receiving slot wherein the inner face of the end wall is farther away from the receiving slot than the inner face of the deflectable latch from the receiving slot in the longitudinal direction;

wherein a leading chamfer is formed one a top edge of both the end wall and the corresponding deflectable latch;

wherein each of said deflectable latch is equipped with a metallic latch for locking the memory module;

wherein each of said end walls is provided with a supporting platform integrally formed therewith; and wherein a tapered transition surface is formed between the inner surface of the end wall and said another inner surface of the corresponding deflectable latch, and said tapered transition surface is facing with the supporting platform.

2. The electrical connector as claimed in claim 1, wherein each of said deflectable latch has a locking lug thereof for locking the memory module.

3. The electrical connector as claimed in claim 1, wherein said end wall is immovable in the longitudinal direction.

4. An electrical connector assembly comprising:

a memory module defining a front edge and a pair of side edges;

an electrical connector including:

an insulative housing including an elongated base with a pair of end walls at two opposite ends along a longitudinal direction, said base including an upper wall and a lower wall opposite to each other with a receiving slot therebetween in a vertical direction perpendicular to said longitudinal direction, and a pair of deflectable latches unitarily forwardly extending respectively from the pair of end walls along a front-to-back direction perpendicular to both the longitudinal direction and the vertical direction;

wherein the memory module is rotated to be retained to the electrical connector in a horizontal position via said pair of deflectable latches with a front edge of the memory module being received within the receiving slot and with an inner face of the deflectable latch intimately touching the corresponding side edge of the memory module in the longitudinal direction while an inner face of the end wall is spaced from the corresponding side edge with a gap therebetween in the longitudinal direction;

wherein a leading chamfer is formed one a top edge of both the end wall and the corresponding deflectable latch;

wherein each of said deflectable latch is equipped with a metallic latch for locking the memory module;

wherein each of said end walls is provided with a supporting platform integrally formed therewith; and wherein a tapered transition surface is formed between the inner surface of the end wall and said another inner surface of the corresponding deflectable latch, and said tapered transition surface is facing with the supporting platform.

5. The electrical connector as claimed in claim 4, wherein each of said deflectable latch has a locking lug thereof for locking the memory module.

6. The electrical connector as claimed in claim 4, wherein said end wall is immovable in the longitudinal direction.

* * * * *